US010187943B2

(12) United States Patent
Tse et al.

(10) Patent No.: US 10,187,943 B2
(45) Date of Patent: Jan. 22, 2019

(54) DIRECT DRIVE LED LIGHTING

(71) Applicant: MOSWAY SEMICONDUCTOR LTD., Hong Kong (CN)

(72) Inventors: Chiu Sing Celement Tse, Hong Kong (CN); On Bon Peter Chan, Hong Kong (CN); Chi Keung Tang, Hong Kong (CN)

(73) Assignee: Mosway Semiconductor Ltd., Hong Kong (CN)

( * ) Notice: Subject to any disclaimer, the term of this patent is extended or adjusted under 35 U.S.C. 154(b) by 0 days.

(21) Appl. No.: 14/736,092

(22) Filed: Jun. 10, 2015

(65) Prior Publication Data

US 2016/0366730 A1 Dec. 15, 2016

(51) Int. Cl.
*H05B 33/08* (2006.01)

(52) U.S. Cl.
CPC ..... *H05B 33/083* (2013.01); *H05B 33/0851* (2013.01)

(58) Field of Classification Search
None
See application file for complete search history.

(56) References Cited

U.S. PATENT DOCUMENTS 7,781,985 B2 * 8/2010 Cross ..... G01R 19/0092 315/224
7,919,928 B2 * 4/2011 Ziegenfuss ..... H05B 33/0815 315/227 R
8,076,868 B2 * 12/2011 Chien ..... H05B 33/0815 315/185 R
8,228,001 B2 * 7/2012 Fan ..... H05B 33/0815 315/169.1
8,569,975 B2 * 10/2013 Uchimoto ..... G09G 3/3406 315/210
2008/0224625 A1 * 9/2008 Greenfeld ..... H05B 33/0818 315/201
2009/0167200 A1 * 7/2009 Brokaw ..... H02M 1/36 315/224
2011/0133659 A1 * 6/2011 Li ..... H05B 33/0815 315/193
2013/0099684 A1 * 4/2013 Cheng ..... H05B 33/0818 315/186

* cited by examiner

*Primary Examiner* — Douglas W Owens
*Assistant Examiner* — Amy Yang
(74) *Attorney, Agent, or Firm* — Muncy, Geissler, Olds & Lowe, P.C.

(57) ABSTRACT

A direct drive LED lighting circuit includes a LED current control circuit with a power switching device; a current sensing device, an averaging circuit, and an error amplifier. A LED chain circuit is formed by connecting several LEDs in series with a capacitor connecting in parallel with the series of LEDs, with a current flowing in side as a positive terminal, and a current leaving terminal as a negative terminal. The LED chain circuit and the LED current control circuit are connecting in series and the whole circuit is connected between the positive and negative terminals of a rectified AC power source.

5 Claims, 15 Drawing Sheets

( a )

( b )

DIRECT DRIVE LED LIGHTING

BACKGROUND OF THE INVENTION

The present invention relates to control circuits for LED lighting. The invention more particularly, although not exclusively, relates to driving LEDs in LED lighting products using direct drive architecture.

PRIOR ART

Prior art typical LED lighting direct drive circuit and the associated concept of LED voltage and current versus the AC cycle are illustrated in FIGS. 1 and 2 respectively. While having the advantage of eliminating the magnetic component as compared with switching mode LED lighting driving circuits, direct drive LED lighting circuits today suffer from the following:

(a) Poor LED utilization due to some LEDs are not at full on state throughout the whole AC input cycle. As LED is the major cost in LED lighting product, this will increase the product cost.

(b) There exists a gap period between AC half cycles that all LEDs are off, as well as the changing of LED current and number of LED that are in on state with each AC half cycle, and hence changing the output brightness. These will create a relatively high flicker effect.

(c) To budget for the input AC voltage variation, the difference between the peak AC voltage and the maximum LED chain voltage is large. This creates substantial heat dissipation at the power switching device, and hence lowering the efficiency in such LED direct drive circuits. This will increase the packaging cost due to the package type selected needs to be able to handle such heat dissipation.

OBJECTS OF THE INVENTION

It is an object of the present invention to overcome or substantially ameliorate some or all the above disadvantages and/or more generally to provide improved control circuits for direct drive LED lighting.

DISCLOSURE OF THE INVENTION

There is disclosed herein a circuit including:

A direct drive LED lighting circuit comprising:

A LED current control circuit with a power switching device; a current sensing device, an averaging circuit, and an error amplifier; wherein The power switching device with a control terminal to control the amount of current flowing through the switching channel, a current inflow terminal and a current outflow terminal as the positive channel terminal and the negative channel terminal of the power switching device respectively; and A current sensing device for sensing the current flowing through the power switching device is connecting between the negative channel terminal of the power switching device and the reference node (lowest voltage) of the control circuit, the output of the current sensing device (or negative channel terminal of the power switching device for particular implementation) is connecting to the input of an averaging circuit; and The averaging circuit with an input connected to the output of the current sensing device, and an output connected to one of the inputs of an error amplifier; and The error amplifier with an output of the averaging circuit as one of the inputs, and reference voltage serving for setting of an average LED current as another input, and an output connected to the control terminal of the power switching device; and A LED chain circuit by connecting several LEDs in series with a capacitor connecting in parallel with the series of LEDs, with a current flowing in terminal as a positive terminal, and a current leaving terminal as a negative terminal;

The LED chain circuit and the LED current control circuit are connecting in series and the whole circuit is connected between the positive and negative terminals of a rectified AC power source.

Optionally, a series diode to prevent the reverse current flow may be added either at the positive terminal or the negative terminal of the rectified AC power source, or between the LED chain circuit and the LED current control circuit.

Optionally, a filter circuit may be added between the error amplifier and the power switching device.

Preferably, the current sensing device can take the form of a simple resistor, or current mirror followed by current to voltage conversion, to produce a voltage representing the current flowing through the power switching device.

Preferably, the averaging circuit can take the form of passive low pass filter, or active low pass filter, or low pass filter with addition of sample and hold control for processing of the averaging function.

It is further disclosed herein a monolithic integrated circuit for direct drive LED light application comprising the following:

A power switching device with a control terminal to control the amount of current flowing through the switching channel, a current inflow terminal and a current outflow terminal as the positive channel terminal and the negative channel terminal of the power switching device respectively; and An error amplifier with an output connected to the control terminal of the power switching device, an input connected to a reference voltage for setting the average current flowing through the power switching device, and another input for obtaining feedback information of the average current flowing through the power switching device.

Optionally, a filter circuit may be added between the error amplifier and the power switching device.

Preferably, an external current sensing device, averaging circuit, and LED chain circuit may be connected to produce intended application circuits.

It is further disclosed herein a direct drive LED lighting circuit comprising:

A LED current control circuit with a power switching device; a current sensing device, an averaging circuit, and a three input error amplifier; wherein The power switching device with a control terminal to control the amount of current flowing through the switching channel, a current inflow terminal and a current outflow terminal as the positive channel terminal and the negative channel terminal of the power switching device respectively; and A current sensing device for sensing the current flowing through the power switching device is connecting between the negative channel terminal of the power switching device and the reference node (lowest voltage) of the control circuit. The output of the current sensing circuit (or negative channel terminal of the power switching device for particular implementation) is also connecting to the input of an averaging circuit; and The averaging circuit with an input connected to the output of the current sensing device, and an output connected to one of the inputs of a three input error amplifier; and The three input error amplifier with the output of the averaging circuit as one of the inputs, and reference voltage serving for setting of an average LED current as another input, and phase (or instantaneous voltage) information of the rectified AC as the third input for instantaneous AC current waveform shaping, and an output connected to the control terminal of the power switching device, and A LED chain circuit by connecting several LEDs in series with a capacitor connecting in parallel with the series of LEDs, with a current flowing in terminal as a positive terminal, and a current leaving terminal as a negative terminal;

The LED chain circuit and the LED current control circuit are connecting in series and the whole circuit is connected between the positive and negative terminals of a rectified AC power source.

Optionally, a series diode to prevent the reverse current flow may be added either at the positive terminal or the negative terminal of the rectified AC power source, or between the LED chain circuit and the LED current control circuit.

Optionally, a filter circuit 311, as shown in FIGS. 3A and 3B, may be added between the connection of the three input error amplifier and the power switching device.

Preferably, the current sensing device can take the form of a simple resistor, or current mirror followed by current to voltage conversion, to produce a voltage representing the current flowing through the power switching device.

Preferably, the averaging circuit can take the form of passive low pass filter, or active low pass filter, or low pass filter with addition of sample and hold control for processing of the averaging function.

It is further disclosed herein a monolithic integrated circuit for direct drive LED light application comprising the following:

A power switching device with a control terminal to control the amount of current flowing through the switching channel, a current inflow terminal and a current outflow terminal as the positive channel terminal and the negative channel terminal of the power switching device respectively; and A three input error amplifier with an output connected to the control terminal of the power switching device, an input connected to a reference voltage for setting the average current flowing through the power switching device, a second input for obtaining feedback information of the average current flowing through the power switching device, and a third input for instantaneous current waveform shaping.

Optionally, a filter circuit may be added between the connection of the error amplifier and the power switching device.

Preferably, an external current sensing device, averaging circuit, and LED chain circuit may be connected to produce intended application circuits.

DESCRIPTION OF THE PREFERRED EMBODIMENT

Figure 3A:
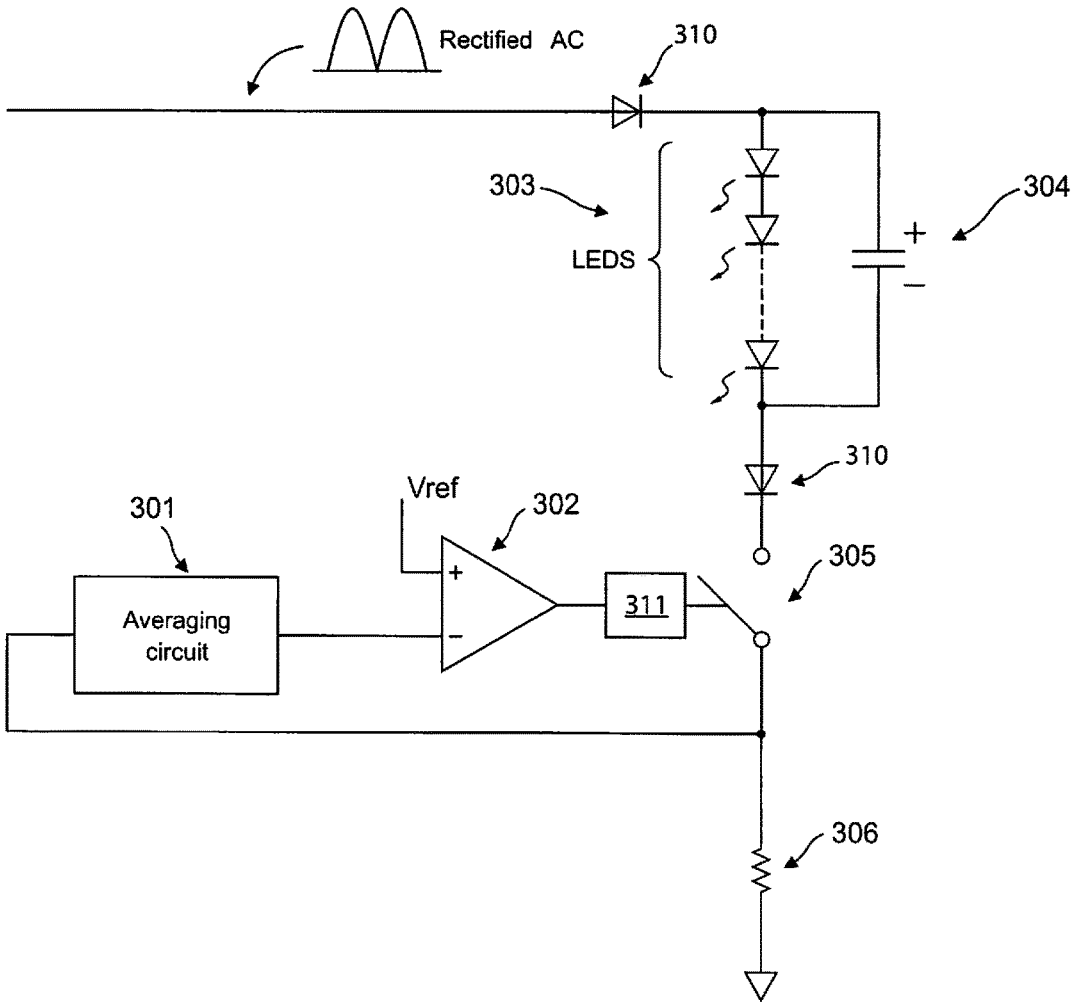
FIGS. 3A and 3B are the invented control circuit for direct drive LED lighting with improved LED utilization and reduced flicker.
Figure 3B:
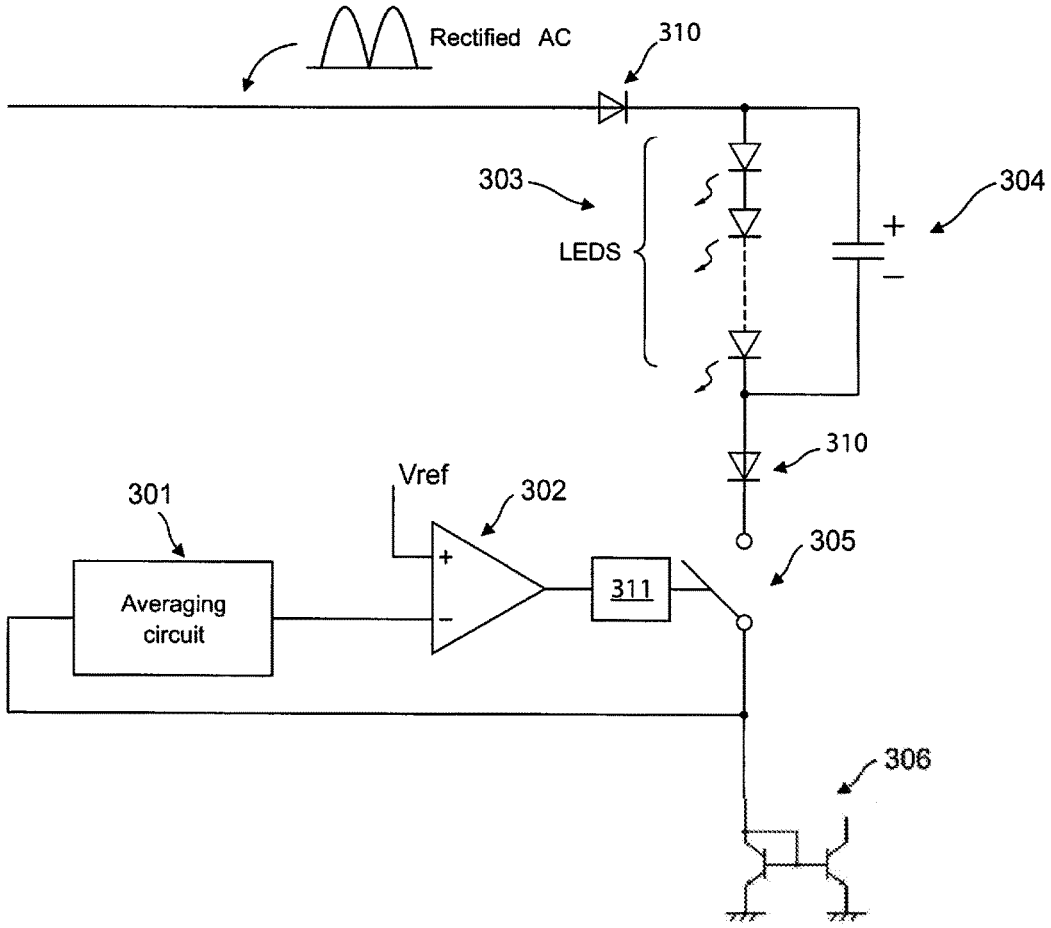

To improve the LED utilization as well as reducing the flicker, a direct drive LED control circuit which has LED current conduction for the whole AC half cycle as well as having low LED current variation, and hence a low flicker index, is required. FIGS. 3A and 3B is the block diagram for such a circuit.

In FIGS. 3A and 3B, current through the LEDs 303 and the capacitor 304 connected across the LEDs 303 during the period that the instantaneous AC input voltage is higher than the minimum LEDs' forward voltage is supplied by the rectified AC. When the instantaneous AC input voltage is below the LEDs' forward voltage, current to the LEDs 303 is supplied by the energy stored in the capacitor 304. Hence, the all off period for the LED chain is eliminated. The per half cycle LED current is controlled by sensing the current through the power switching device 305 via the current sensing device 306 (e.g., a resistor as shown in FIG. 3A and a current mirror shown in FIG. 3B), with an averaging circuit 301 to produce the feedback to error amplifier 302 for completing the feedback loop. Another input for setting the LED current is the internally generated Vref, which is connected to another input of error amplifier 302. Output of error amplifier 302 is directly connected, or optionally via a filter, to the control input of the power switching device 305. This feedback loop determines the current profile via power switching device 305, and hence the long term LED average current. Optionally, a series diode 310 as shown in FIGS. 3A and 3B, to block the reverse current flow may be added to the positive or negative side of the rectified AC power source, or between the parallel circuit formed by the LED chain 303 and the capacitor 304 and the power switching device 305.

Figure 1:
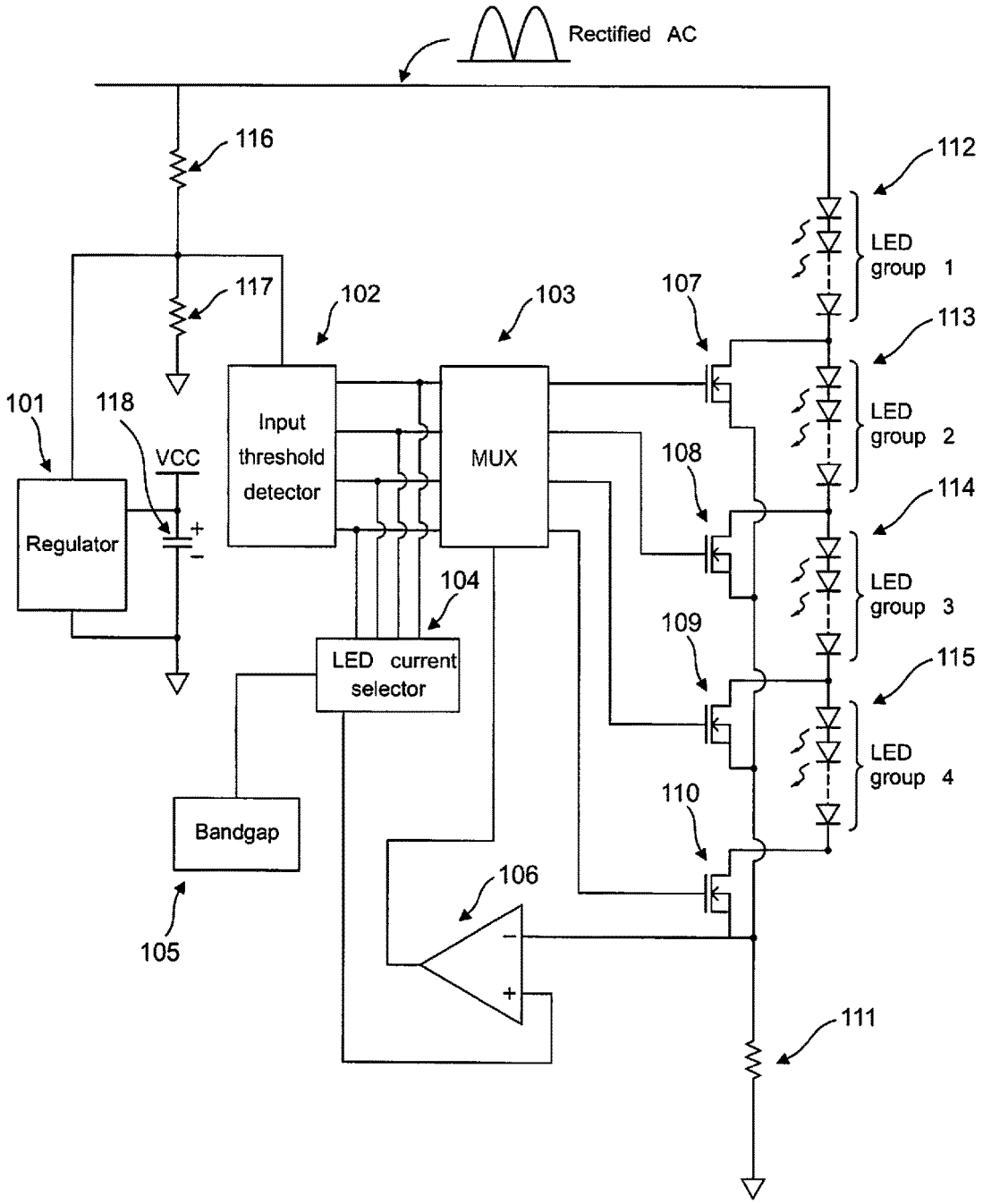
(PRIOR ART) Fig. 1
FIG. 1 is a typical block diagram of control circuit for direct drive LED lighting.
Figure 2:
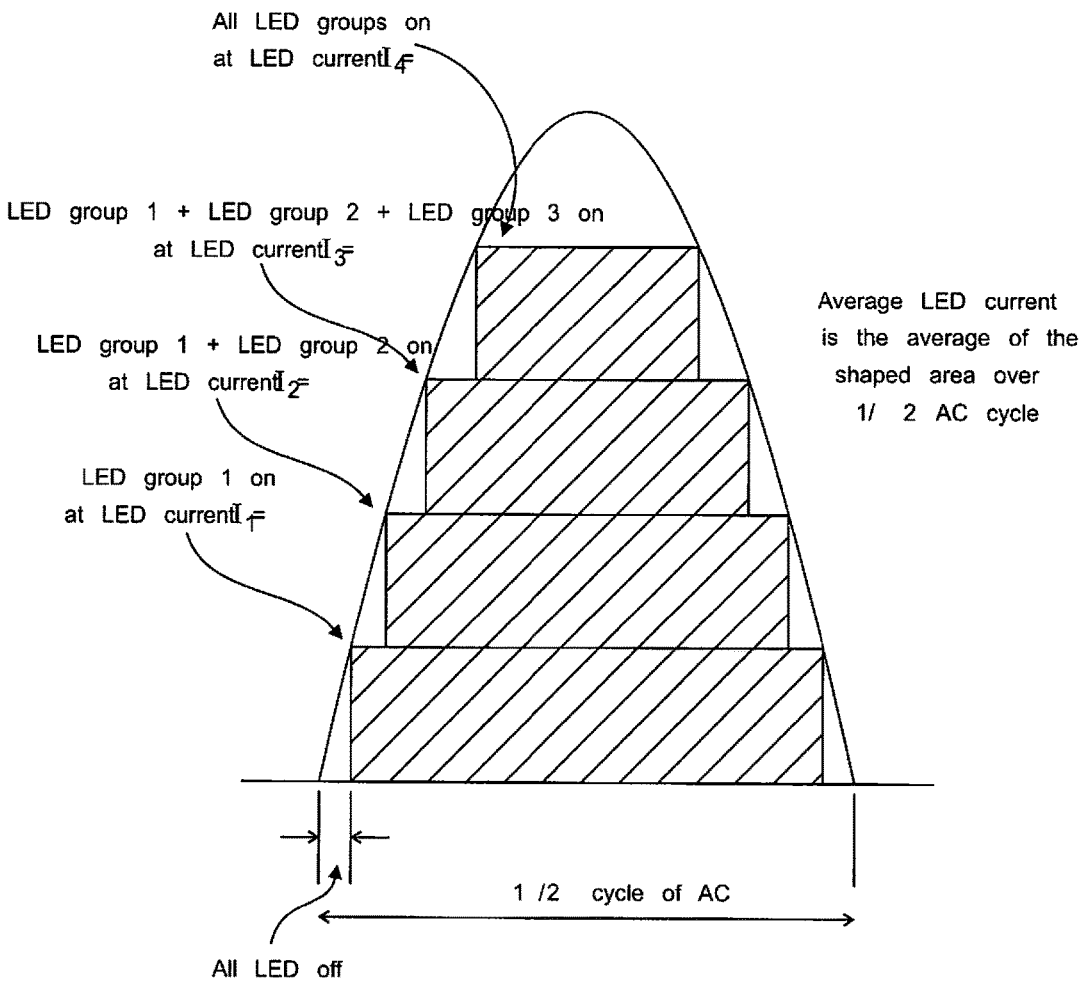
(PRIOR ART) Fig. 2
FIG. 2 is the LED voltage and current versus the AC half cycle waveform for control circuit in FIG. 1.
Figure 4:
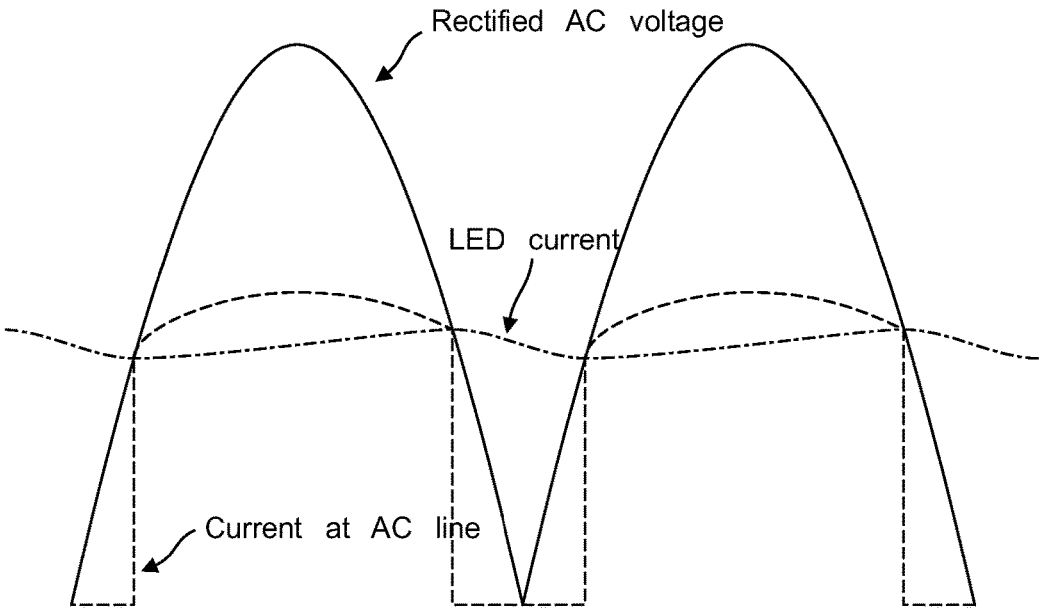
FIG. 4 is the waveforms for rectified AC voltage, AC line current and LED current for circuit shown in FIGS. 3A and 3B.

FIG. 4 illustrates the AC half cycle voltage and current, as well as the LED current. It can be observed that the LED chain remains on for every full half cycle of AC as well as having relatively small current variation. Hence, flicker is reduced substantially as compared with the circuit shown in FIG. 1. In addition, the LED utilization is practically near 100%. However, the power factor performance is not as good as the prior act (which is practically near 1) but still satisfactory (near 0.9 with proper selection of voltage of the LED chain). Major heat dissipation at regions near the peak of the AC half cycles is similar.

Figure 5:
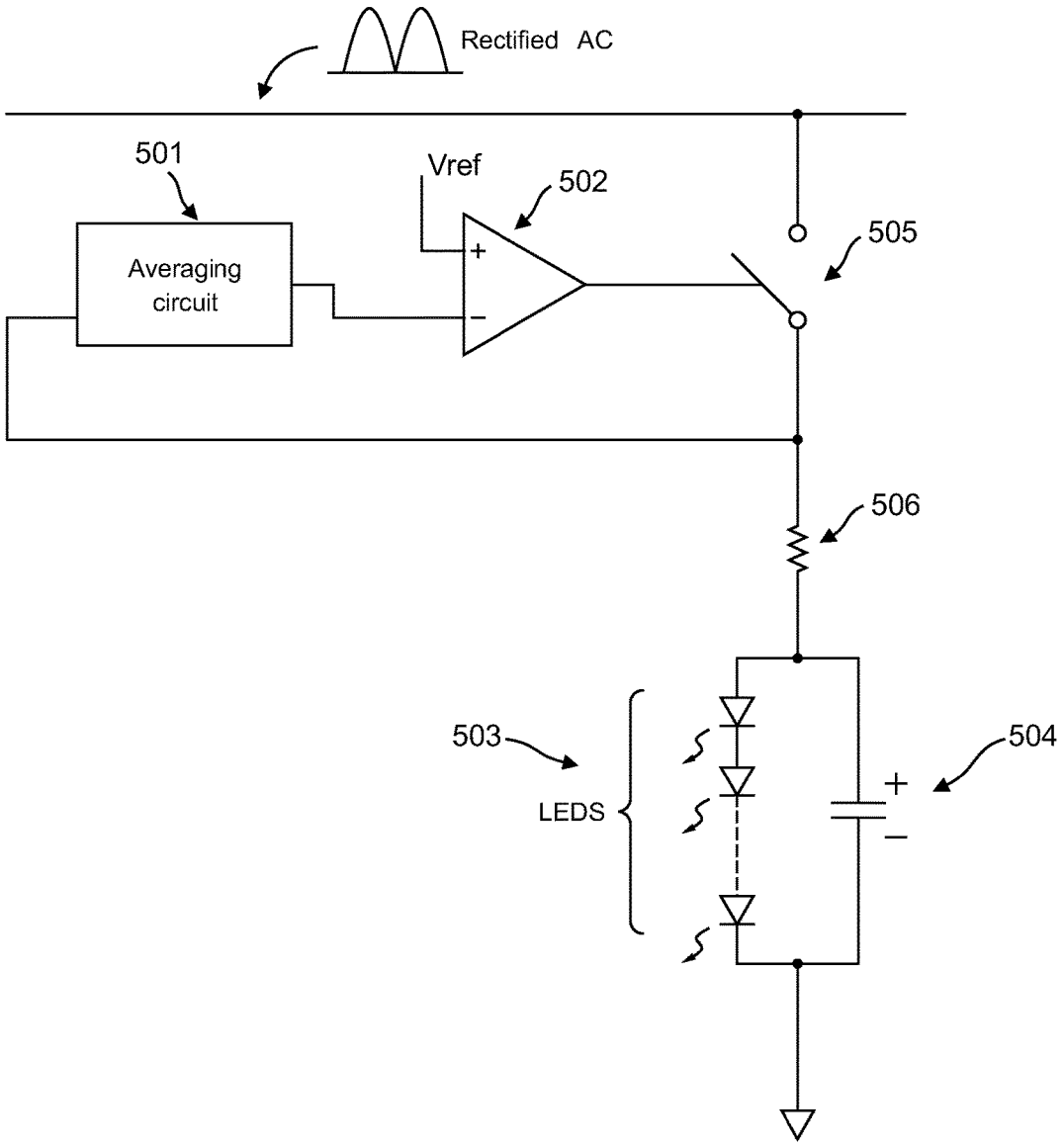
FIG. 5 is an alternative circuit connection for achieving the same function as FIG. 3A using the same circuit blocks.

Instead of having the parallel circuit formed by LEDs 303 and capacitor 304 connected between the positive side of the rectified AC and the positive terminal of the power switching device 305 in FIG. 3A, it is an alternative to connect this parallel circuit between the negative side of the current sensing device and the negative terminal of the rectified AC power source, and the positive terminal of the power switching device is connecting to the positive terminal of the rectified AC power source. FIG. 5 illustrates this alternative interconnecting circuit for achieving the same function.

Figure 6:
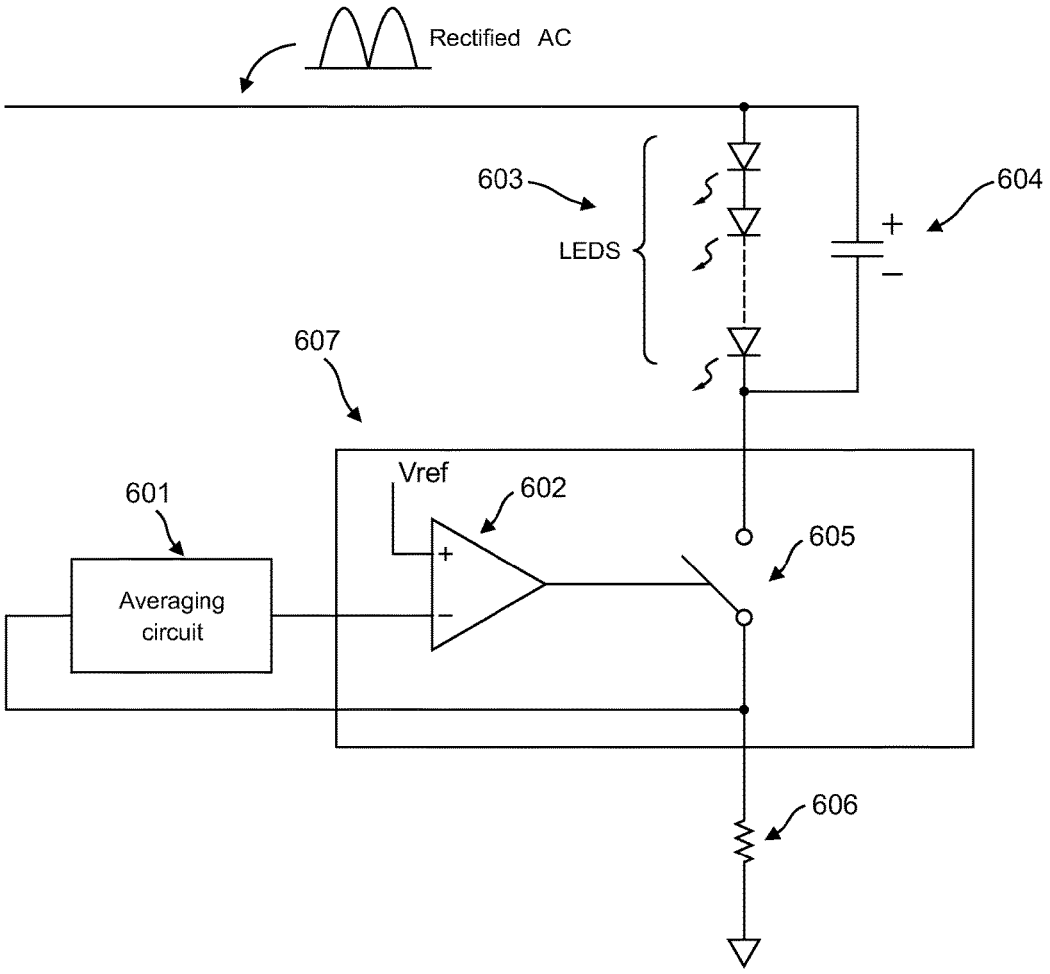
FIG. 6 is the same as FIG. 3A with the blocks that is possible to be integrated into a monolithic IC using ultra high voltage bipolar complementary metal oxide semiconductor double diffused metal oxide semiconductor (bipolar CMOS DMOS or "BCD") silicon process shown as a combined block.

It is a preferred embodiment of this invention to integrate device 302 and 305 into a monolithic integrated circuit 607 as shown in FIG. 6 using ultra high voltage (500-700V) BCD processes that are available in recent years. The same monolithic circuit may be used to replace devices 502 and 505 in the circuit shown in FIG. 5.

Figure 7A:
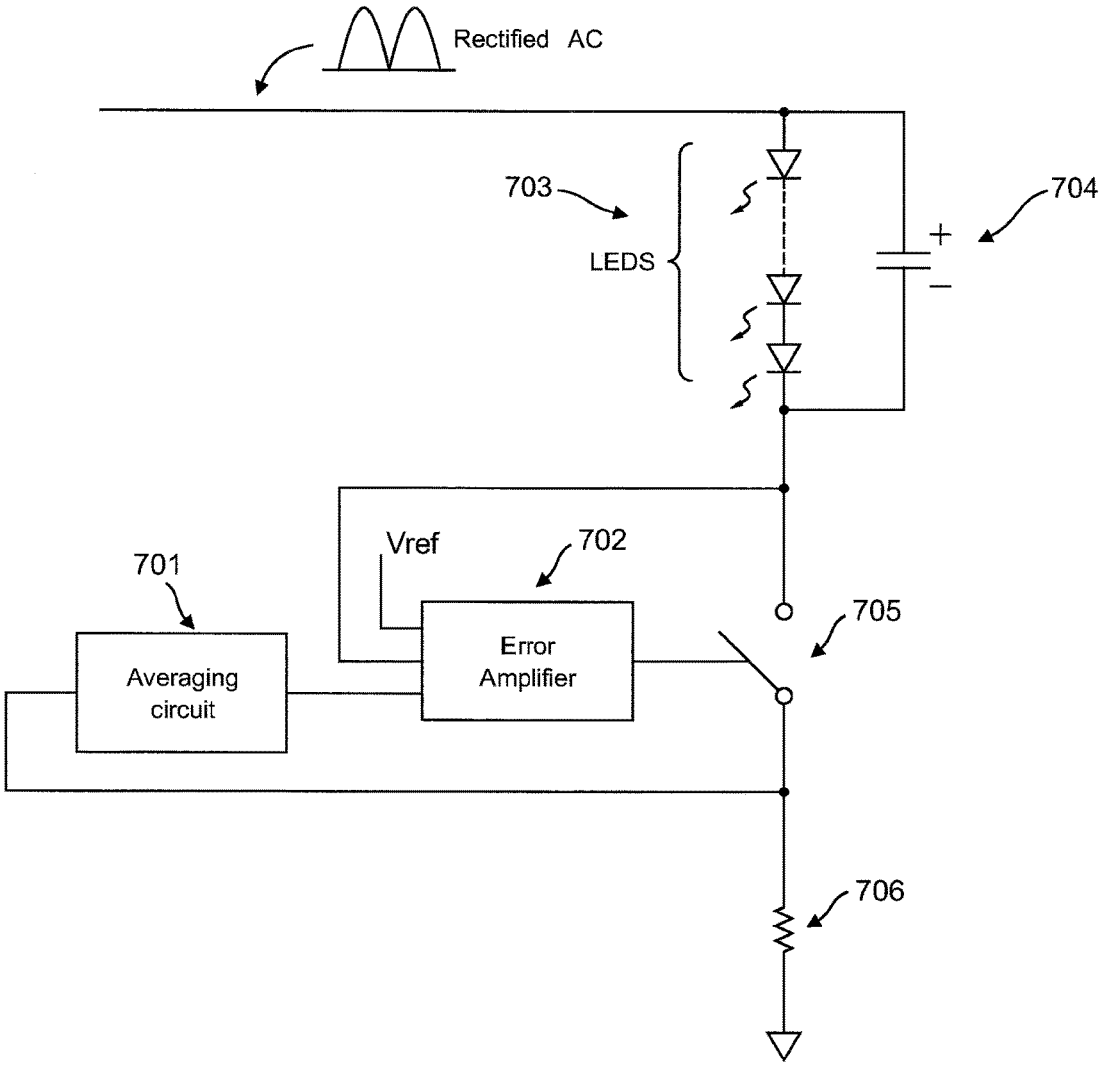
FIGS. 7A and 7B are another invented control circuit for direct drive LED lighting with improved LED utilization, reduced flicker, and improved efficiency.

A further innovation of this invention to reduce the heat dissipation at the power switching device. This is achieved by reducing the current flowing through the power switching device when the AC instantaneous voltage is above a selected value. During such period, the LED current is the sum of the AC input current plus the current supplied by the capacitor in parallel with the LED chain. While the instantaneous LED current is reduced during such period, the long term average LED current remains constant according to the target set by the reference voltage and sensed by a current sensing device 706. FIG. 7A illustrates a preferred design.

FIG. 7A is a modified version of FIG. 3A in which the two input error amplifier 302 is replaced by a three input error amplifier 702. Besides the original 2 inputs, a third input, which contains the voltage information of the AC line, is added to wave shape the AC current as described in the previous paragraph. When the AC instantantaneous voltage is above a pre-determined level, the AC input current is reduced according to the voltage in excess of the pre-selected level. This additional control signal has fast response and therefore modulates the AC line current immediately. While the signal for the third input pin of the error amplifier 702 is taken indirectly from the positive channel terminal of the power switching device in FIG. 7, it can also be optionally taken from a resistor divider across the rectified AC power source. Preferred design embodiments for the three input amplifier 702 are shown in FIG. 8.

Figure 8:
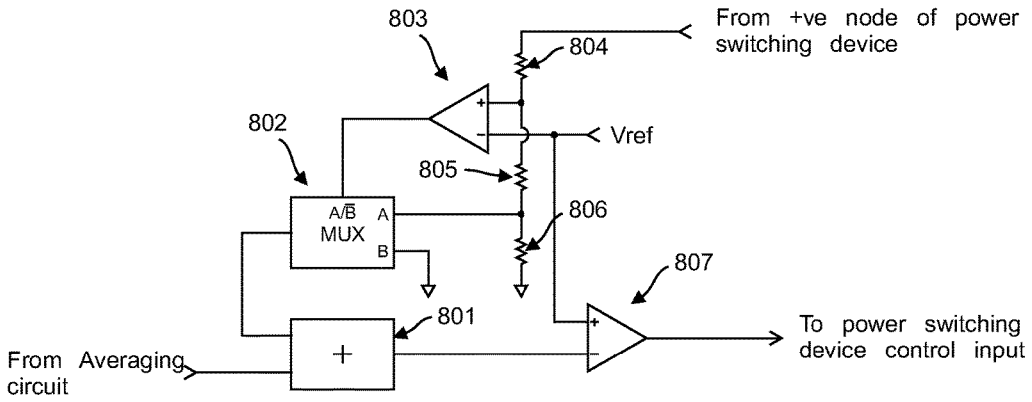
FIG. 8 illustrates two preferred design embodiments for the three input error amplifiers in FIGS. 7A and 7B.
Figure 8:
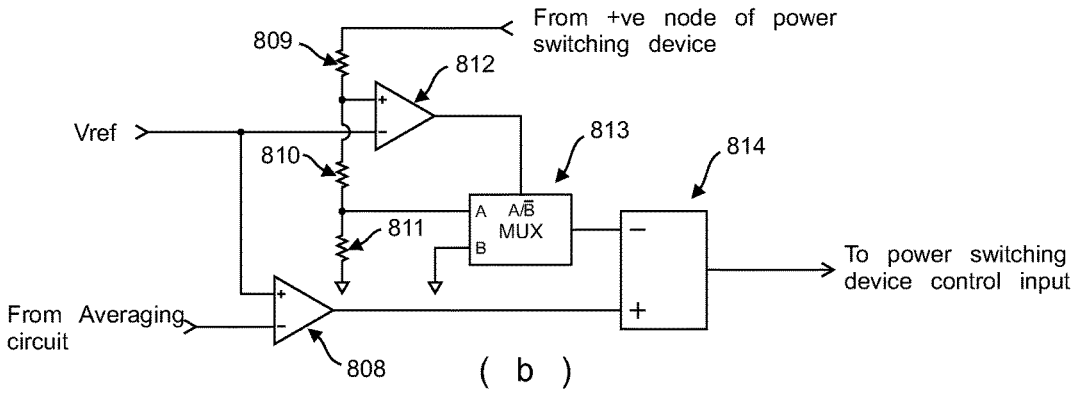

In FIG. 8(*a*), resistors 804, 805 and 805 divide down the signal from the positive channel terminal of the power switching device. Comparator 803 compares one of the divided down signal with Vref to generate a control signal for the analogue multiplexor MUX 802. When the AC instantaneous voltage is above a desired value, this control signal is a logical '1'. When the AC instantaneous voltage is below such desired value, this control signal is a logical '0'. When the control sign is '1', MUX 802 selects a divided down signal of the positive channel terminal of the power switching device (which carries the information of instantaneous rectified AC voltage) to its output terminal. When the control sign is logical '0', MUX 802 selects a ground potential to its output terminal. The output of the MUX 802 is summed with the output from the averaging circuit to generate the signal for one of the input of the error amplifier 807. Another input for error amplifier 807 is the Vref. Output of error amplifier 807 is then used to control the power switching device. With this circuit, current through the power switching device, and hence the AC line current, will be reduced near the peak of the AC cycle.

In FIG. 8(*b*), resistors 809, 810 and 811 divide down the signal from the positive channel terminal of the power switching device. Comparator 812 compares one of the divided down signal with Vref to generate a control signal for the analogue multiplexor MUX 813. When the AC instantaneous voltage is above a desired value, this control signal is a logical '1'. When the AC instantaneous voltage is below such desired value, this control signal is a logical '0'. When the control sign is logical '1', MUX 813 selects a divided down signal of the positive channel terminal of the power switching device to its output terminal. When the control sign is '0', MUX 813 selects a ground potential to its output terminal. The output of the MUX 813 is subtracted from the output of the error amplifier 808 to generate control signal for the power switching device. Error amplifier 808 takes the output from the averaging circuit and Vref as inputs for controlling the long term average LED current. With this circuit, current through the power switching device, and hence the AC line current, will be reduced near the peak of the AC cycle.

Figure 7B:
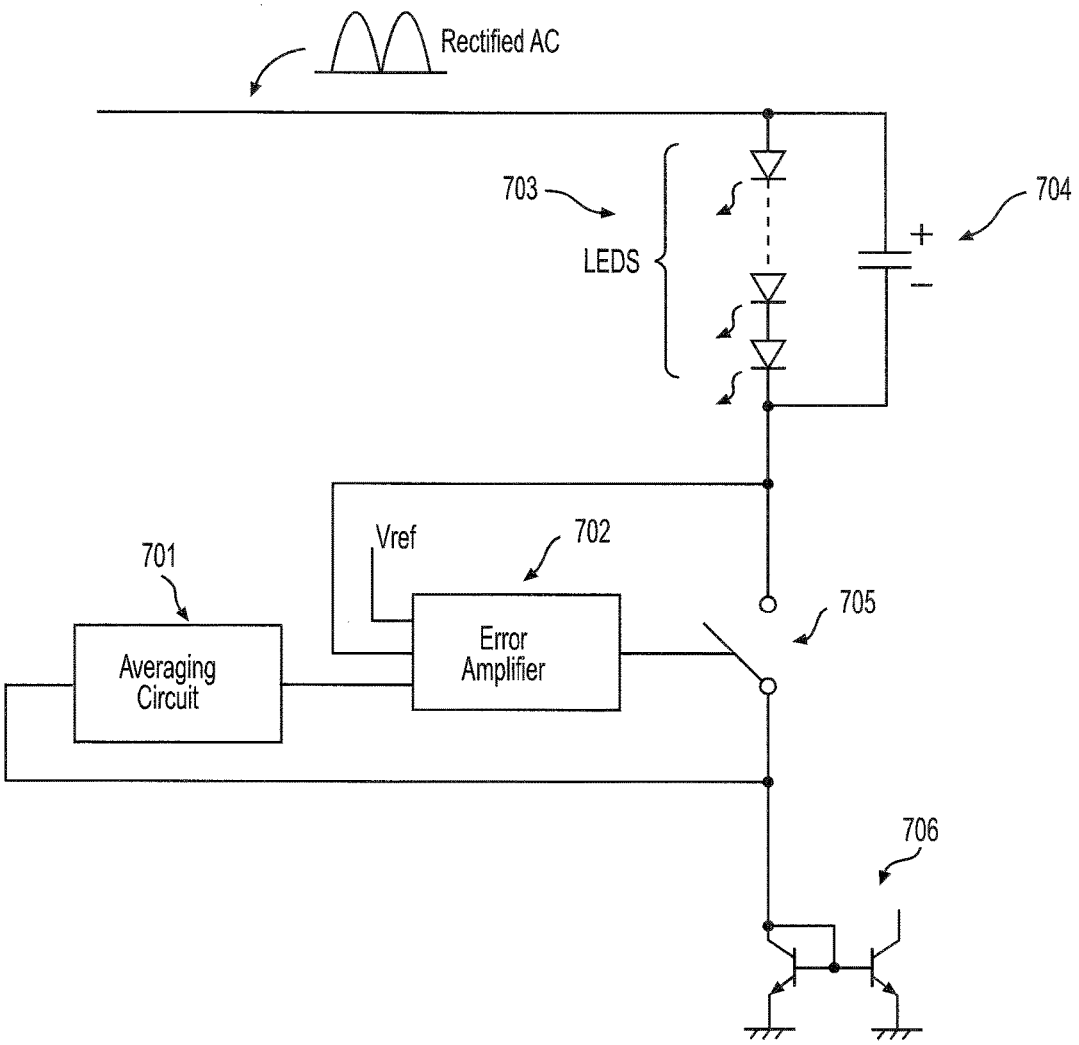
Figure 9:
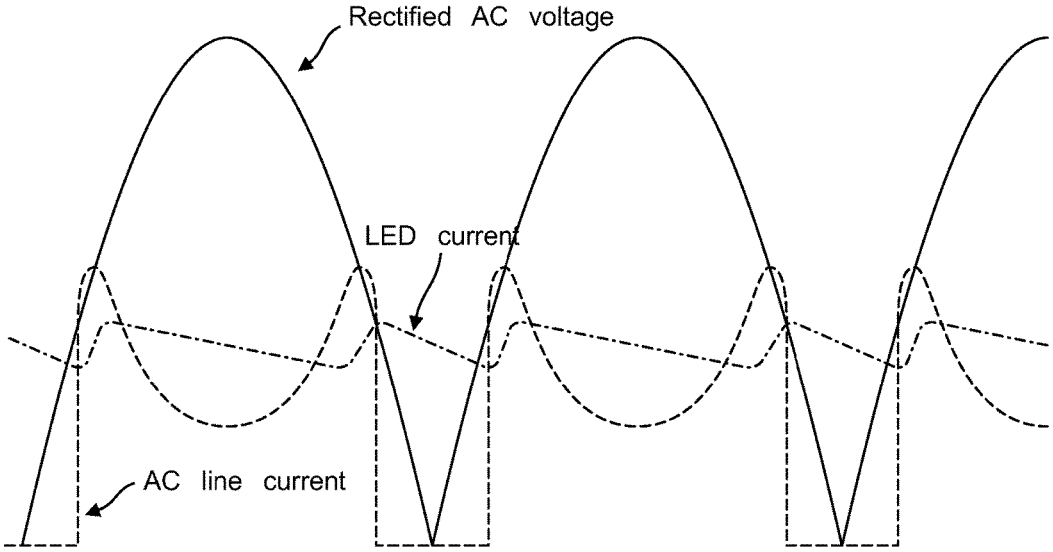
FIG. 9 is the waveforms for rectified AC voltage, AC line current and LED current for circuit shown in FIGS. 7A and 7B using a selected error amplifier from FIG. 8.

FIG. 9 shows waveforms of key circuit nodes of FIGS. 7A and 7B. With the invented circuit using a selected error amplifier as shown in FIG. 8, the heat dissipation at the power switch near the peak voltage of the AC cycle is reduced and hence the efficiency is improved, at the expenses of lowering the power factor.

Figure 10:
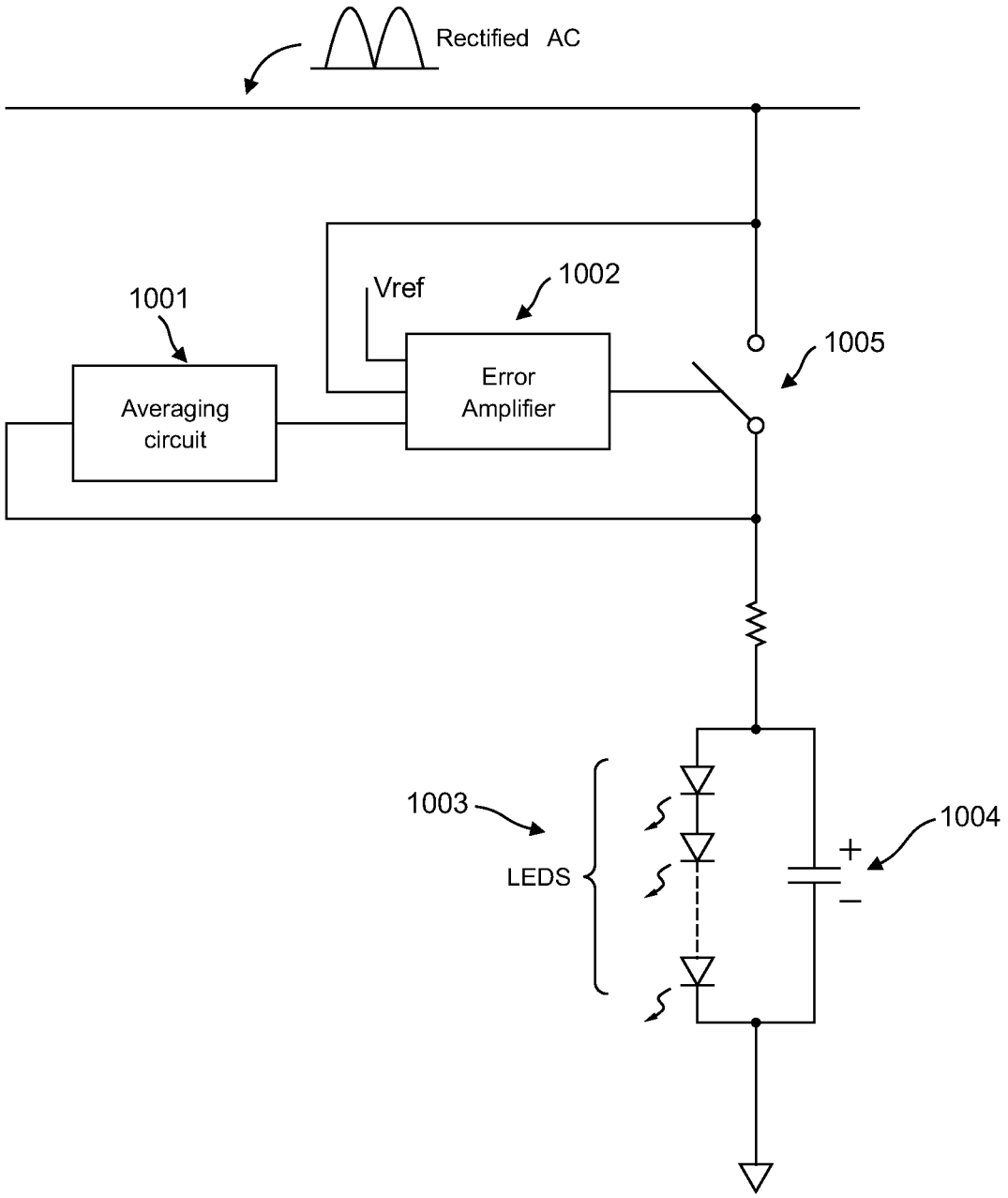
FIG. 10 is an alternative circuit connection for achieving the same function as FIG. 7A using the same circuit blocks.

Instead of having the parallel circuit formed by LEDs 703 and capacitor 704 connected between the positive side of the rectified AC and the positive terminal of the power switching device 705 in FIG. 7A, it is an alternative to connect this parallel between the negative side of the current sensing device and the negative terminal of the rectified AC power source, and the positive terminal of the power switching device is connecting to the positive terminal of the rectified AC power source. FIG. 10 illustrates this alternative interconnecting circuit for achieving the same function.

Figure 11:
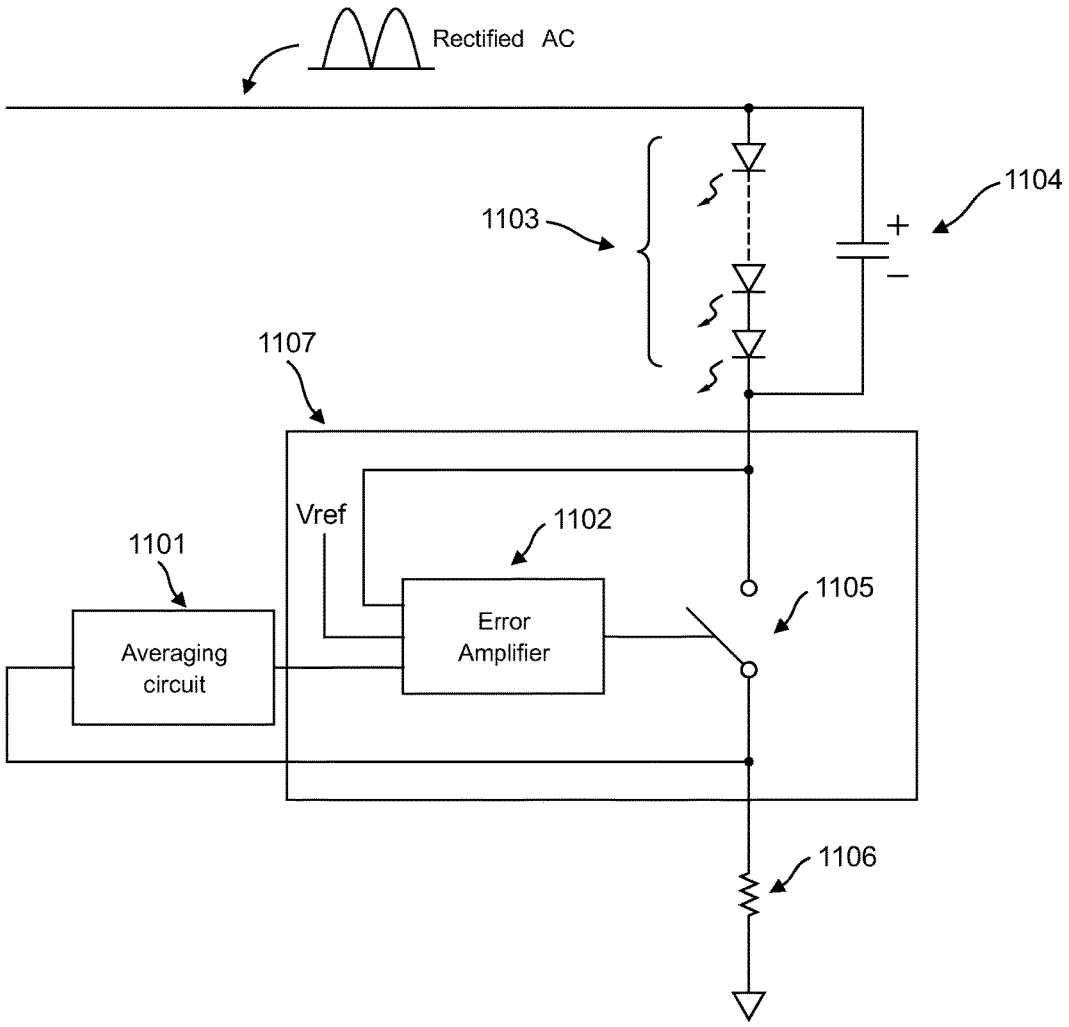
FIG. 11 is the same as FIG. 7A with the blocks that is possible to be integrated into a monolithic IC using ultra high voltage BCD process shown as a combined block.

It is another preferred embodiment of this invention to integrate device 702, and 705 into a monolithic integrated circuit 1107 as shown in FIG. 11 using ultra high voltage (500-700V) BCD processes that are available in recent years. The same monolithic circuit may be used to replace devices 1002 and 1005 in the circuit shown in FIG. 10.

Figure 12:
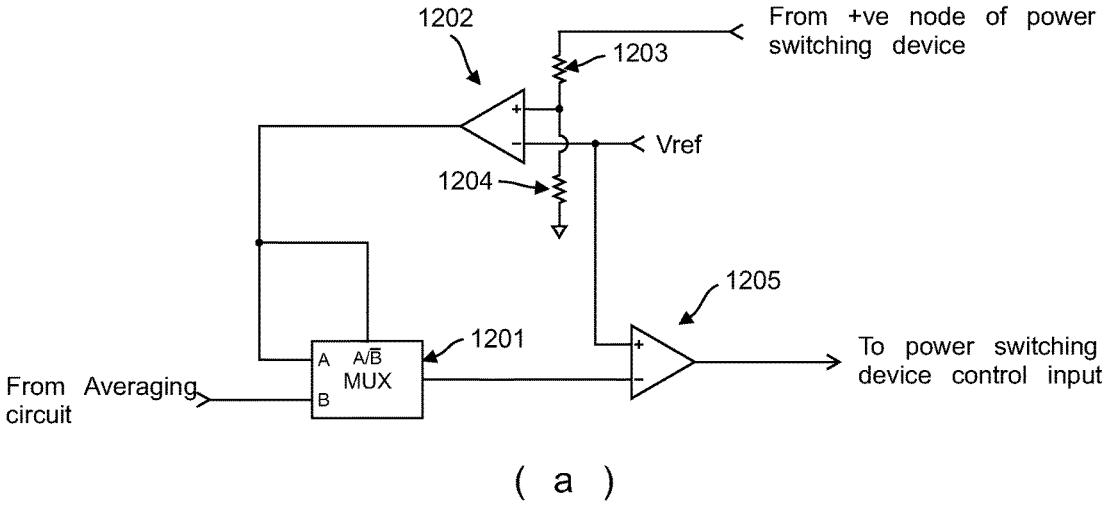
FIG. 12 illustrates another two preferred design embodiments for the three input error amplifiers in FIGS. 7A and 7B to provide additional efficiency improvement.
Figure 12:
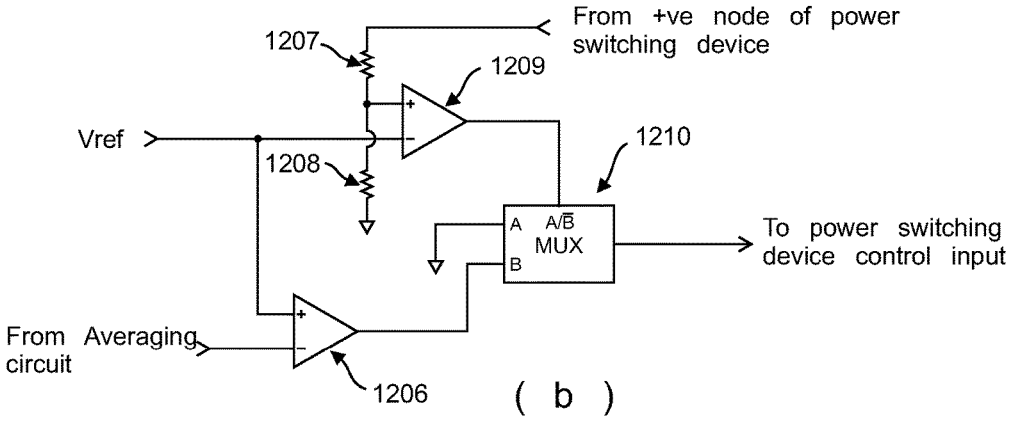

As an extreme implementation of the previous implementation, instead of reducing the AC input current near the AC peak according to AC instantaneous voltage exceeding a selected level, AC current can be totally removed when the AC instantaneous voltage exceeds a selected level. This can totally eliminate the heat dissipation near the peak of the AC cycle, and hence improving the efficiency to the maximum according to the principle of this invention. FIG. 12 illustrates two preferred design embodiments for the three input error amplifier in FIGS. 7A9-7B and FIG. 10 to achieve the desired effect.

In FIG. 12(*a*), resistors 1203 and 1204 divide down the signal from the positive channel terminal of the power switching device. Comparator 1202 compares the divided down signal with Vref to generate a control signal for the analogue multiplexor MUX 1201. When the AC instantaneous voltage is above a desired value, this control signal is a logical '1'. When the AC instantaneous voltage is below such desired value, this control signal is a logical '0'. When the control sign is logical '1', MUX 1201 selects a logical '1', or the supply voltage for the control circuit, to its output terminal. When the control sign is logical '0', MUX 1201 selects the output from the averaging circuit to its output terminal. The output of the MUX 1201 and Vref are inputs for error amplifier 1205 to generate the control signal for the power switching device. With this circuit, current through the power switching device, and hence the AC line current, will be totally eliminated when the AC instantaneous voltage is above the desired value.

In FIG. 12(*b*), resistors 1207 and 1208 divide down the signal from the positive channel terminal of the power switching device. Comparator 1209 compares the divided down signal with Vref to generate a control signal for the analogue multiplexor MUX 1210. When the AC instantaneous voltage is above a desired value, this control signal is a logical '1'. When the AC instantaneous voltage is below such desired value, this control signal is a logical '0'. When the control sign is logical '1', MUX 1210 selects a logical '0', or zero potential of the current control circuit, to its output terminal. When the control sign is '0', MUX 1210 selects the output from output of error amplifier 1206. The output of the MUX 1210 is used to control the power switching device. Error amplifier 1206 uses Vref and the output from the averaging circuit as inputs. With this circuit, current through the power switching device, and hence the AC line current, can be totally eliminated when the AC instantaneous voltage is above the desired value.

Figure 13:
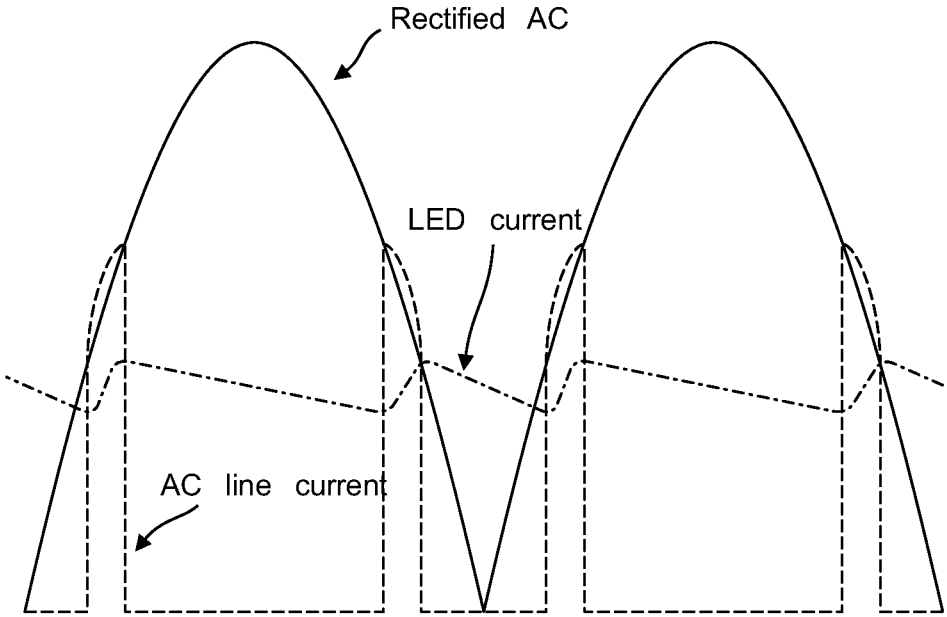
FIG. 13 is the waveforms for rectified AC voltage, AC line current and LED current for circuit shown in FIGS. 7A and 7B using a selected error amplifier from FIG. 12.

FIG. 13 shows waveforms of key circuit nodes of FIGS. 7A and 7B. With the invented circuit using a selected three input error amplifier as shown in FIG. 12, the heat dissipation at the power switch is reduced and hence the efficiency is improved, at the expenses of lowering the power factor.

The invention claimed is:

1. A direct drive LED lighting circuit comprising:
- a LED current control circuit comprising
- a power switching device comprising
- a switching channel;
- a control terminal coupled to the switching channel;
- a positive channel current inflow terminal; and
- a negative channel current outflow terminal;
- a current sensing device sensing a current in the power switching device between the positive channel inflow terminal and the negative channel current outflow terminal, wherein the current sensing device is a current mirror that produces a voltage corresponding to a current flow through the power switching device;
- a filter circuit electrically coupled between a three input error amplifier and the power switching device;
- an averaging circuit electrically coupled to the current sensing device, wherein the averaging circuit is an active low pass filter, wherein the averaging circuit further comprises a sample and hold control for processing of an averaging function; and
- the three input error amplifier electrically coupled to the averaging circuit, comprising
- a first input electrically coupled to a reference voltage;
- a second input electrically coupled to an LED chain circuit;
- a third input electrically coupled to the averaging circuit; and
- an output coupled to the control terminal of the power switching device, and
- the LED chain circuit;
- a plurality of LEDs electrically coupled in series;
- a capacitor electrically coupled in parallel with the plurality of LEDs;
- a positive terminal; and
- a negative terminal, wherein the LED current control circuit and the LED chain circuit are electrically coupled in series;
- a diode electrically coupled to the LED current control circuit and the LED chain circuit; and
- a rectified AC power source electrically coupled to the LED current control circuit and the LED chain circuit;
- wherein under a condition when an instantaneous voltage of the rectified AC power source is above a predetermined level, the input current of the rectified AC power source is reduced according to a voltage in excess of the predetermined level.

2. The direct drive LED lighting circuit of claim 1, further comprising a diode electrically coupled to the rectified AC power source and the direct drive LED lighting circuit.

3. A direct drive LED lighting circuit comprising: a LED current control circuit comprising a power switching device comprising a switching channel; a control terminal coupled to the switching channel; a positive channel current inflow terminal; and a negative channel current outflow terminal; a current sensing device sensing a current in the power switching device between the positive channel inflow terminal and the negative channel current outflow terminal, wherein the current sensing device is a resistor that produces a voltage corresponding to a current flow through the power switching device; a filter circuit electrically coupled between a three input error amplifier and the power switching device; an averaging circuit electrically coupled to the current sensing device, wherein the averaging circuit is an active low pass filter, wherein the averaging circuit further comprises a sample and hold control for processing of an averaging function; and the three input error amplifier electrically coupled to the averaging circuit, comprising a first input electrically coupled to a reference voltage; a second input electrically coupled to an LED chain circuit; a third input electrically coupled to the averaging circuit; and an output coupled to the control terminal of the power switching device, and the LED chain circuit; a plurality of LEDs electrically coupled in series; a capacitor electrically coupled in parallel with the plurality of LEDs; a positive terminal; and a negative terminal, wherein the LED current control circuit and the LED chain circuit are electrically coupled in series; a diode electrically coupled to the LED current control circuit and the LED chain circuit; and a rectified AC power source electrically coupled to the LED current control circuit and the LED chain circuit; wherein under a condition when an instantaneous voltage of the rectified AC power source is above a predetermined level, the input current of the rectified AC power source is reduced according to a voltage in excess of the predetermined level.

4. A monolithic integrated LED current control circuit comprising
- a power switching device comprising
- a control terminal;
- a switching channel electrically coupled to the control terminal;
- a positive channel current inflow terminal; and
- a negative channel current outflow terminal;
- a filter circuit electrically coupled between a three input error amplifier and the power switching device;

an averaging circuit directly coupled between the negative channel current outflow terminal of the power switching device and the three input error amplifier;

the three input error amplifier comprising an output electrically coupled to the filter circuit;

a first input electrically coupled to a reference voltage;

a second input electrically coupled to the averaging circuit; and a third input electrically coupled to the switching channel.

5. The monolithic integrated LED current control circuit of claim 4, further comprising a current sensing device electrically coupled to the positive channel current inflow terminal and the negative channel current outflow terminal of the power switching device, and wherein the monolithic integrated LED current control circuit and an LED chain circuit are electrically coupled to a rectified AC power source.

* * * * *